United States Patent [19]

Werber

[11] 4,156,969

[45] Jun. 5, 1979

[54] GARMENT DESIGNING AID

[76] Inventor: Fred W. K. R. Werber, 29 Schaumans-kamp, Reinbeck, Hamburg, Fed. Rep. of Germany

[21] Appl. No.: 853,668

[22] Filed: Nov. 21, 1977

[30] Foreign Application Priority Data

Nov. 19, 1976 [GB] United Kingdom ..... 48456/76
Mar. 9, 1977 [ZA] South Africa ..... 77/1434

[51] Int. Cl.[2] ..... A41H 3/015
[52] U.S. Cl. ..... 33/14
[58] Field of Search ..... 33/14, 16

[56] References Cited

U.S. PATENT DOCUMENTS

| | | | |
|---|---|---|---|
| 422282 | 2/1890 | Baughman et al. | 33/14 |
| 1,260,849 | 3/1918 | Zech | 33/14 |

FOREIGN PATENT DOCUMENTS

| | | | |
|---|---|---|---|
| 1017985 | 12/1952 | France | 33/14 |
| 27752 of | 1908 | United Kingdom | 33/14 |

*Primary Examiner*—Charles E. Phillips

*Attorney, Agent, or Firm*—Ladas, Parry, Von Gehr, Goldsmith & Deschamps

[57] ABSTRACT

This invention provides a garment design aid. In one embodiment the invention comprises a bodice design aid having a rigid spine, a rigid rib slidable along the spine and projecting therefrom and a number of template panels two of which are used at a time, together with the rib and spine, to provide a pattern for the bodice. The panels are slidably secured to the rib and spine so that the size of the pattern may be varied. The position and shape of darts is indicated by members that are pivotally attached to the template panels. In another embodiment the invention comprises a pants design aid which has three template panels that are slidably interconnected to cater for size variations. This aid further has a pivoted member to vary the crutch depth of the pants and two further pivoted members for varying the hip size of the pants. Finally in a further embodiment of the invention there is provided a skirt design aid which has four template panels that are slidably secured together to be pivotally and/or linearly relatively displaceable, so as to cater for different sizes and skirt styles. This skirt aid also has two pivoted members for varying hip sizes.

8 Claims, 12 Drawing Figures

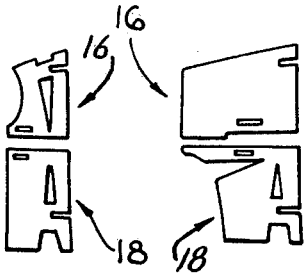
FIG.6
FIG.7
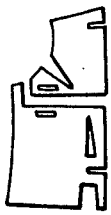
FIG.8
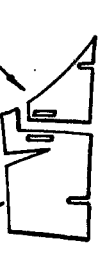
FIG.9
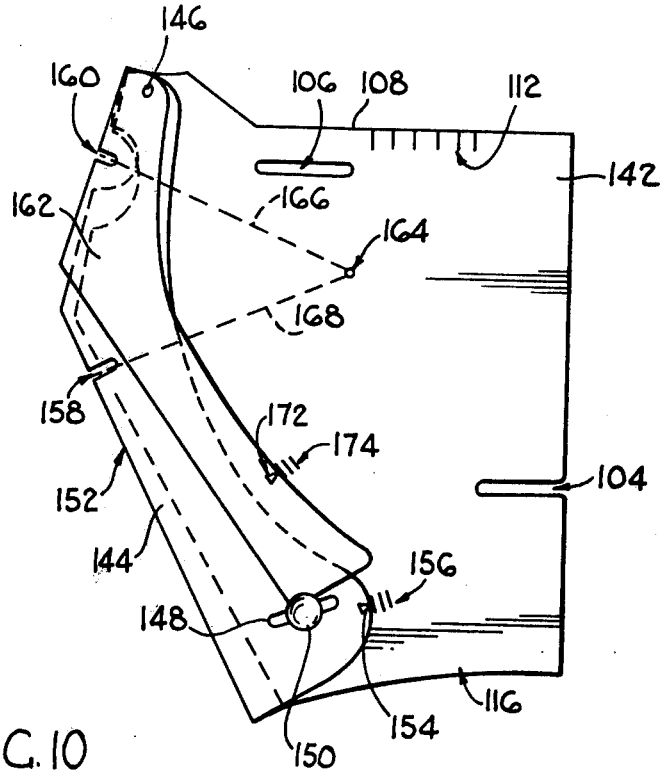
FIG.10

GARMENT DESIGNING AID

This invention relates to a pattern designing aid. More particularly, the invention relates to an aid for assisting a person in designing garments generally, and more specifically for bodices, pants and skirts.

Conventionally, women who do their own sewing and are unable to design clothing rely on purchased patterns for making dresses. These patterns come in fixed sizes predetermined by statistics and do not cater for in-between sizes and items such as differences in bust, waist, neck and arm measurements.

There is, of course, also a system by means of which small patterns may be enlarged to given sizes by a special kit. This system does not always suit all dressmakers since it calls for the drawing of the pattern from a series of dots.

Garments such as bodices, pants and skirts normally can be considered to consist of four panels which when joined together form the bodice, pants or skirt as the case may be. For example, with a bodice, when the four panels are joined together, they form the back and front of the bodice with arm-holes, a neck opening and a waist opening. It will be appreciated that the panels are in pairs—a front pair and a back pair. Each panel of a pair is a mirror image of the other panel of that pair. For a given garment, one thus need essentially a pattern for one front panel and a pattern for one back panel. Thereafter, the panels can be cut as mirror images of the ready cut panels.

According to a first aspect of the invention, there is provided a bodice design aid for assisting a person in providing a pattern for a bodice, the design aid including a rigid spine;

a rigid rib projecting outwardly from the spine to define an upper quadrant on one side of the rib and a lower quadrant on the other side of the rib;

a plurality of first panels which are each detachably securable to the rib and to the spine to fill the first quadrant;

a plurality of second panels which are each detachably securable to the rib and to the spine to fill the second quadrant; and a securing means for detachably securing a first panel and a second panel to the rib and the spine.

Conveniently, the rib may be adjustably displaceable longitudinally along the spine and the first and the second panels may be adjustably displaceable laterally with respect to the spine. Further, the spine may have an adjustable edge member on its side opposed to the rib that is adjustably displaceable towards and away from the spine. In this way, as the position of the rib is variable the first and second panels may vary considerably in size, shape and configuration. Further, as the first and second panels and the edge member are displaceable towards and away from the spine, patterns of varying bust sizes may be provided.

In order to vary the waist dimension of the bodice, some or all of the second panels may have a length varying means for adjusting the length of their lower sides.

It will be appreciated that with most bodice patterns, darts are required. Thus, either or both of the first and second panels may have dart indicating means. More particularly, the second panel may have a bust dart indicating means and a dart varying means to vary the shape and position of the bust dart in accordance with the waist dimension, i.e. the length of the second panel's lower side.

In order to provide a suitable design for both the front and back panels of the bodice, either the same first and second panels may be used for both the back and front panels of the bodice, or first and second front panels and first and second back panels of similar design may be utilized for the front and back panels of the bodice, the first and second panels being appropriately utilised.

It will be appreciated further that the upper sides of the first panels will define a shoulder seam, and their outer sides will define all or part of an arm hole seam of the bodice. Similarly, the outer sides of the second panels will define at least a part of the side seam of the bodice and depending on the particular design, the entire side seam and part of the arm-hole seam. Thus, the upper end of the spine may be shaped to provide a neck opening. Preferably, the upper end of the spine is shaped to provide a front neck opening and a back neck opening defining member is provided which is removably securable to the upper end of the spine when the design aid is to be utilised for the back bodice panels.

Referring once more to the bust dart, the dart varying means may be adapted to maintain the lengths of the sides of the bust dart equal with respect to a predetermined bust point as the waist dimension is varied. Conveniently, the waist dimension may be varied by providing a first flap that is pivotally secured at one end to an upper and outer corner portion of the second panel, the first flap having a pointer indicating the termination point of the bottom side of the bust dart. Thus, as this first flap is pivoted to vary the length of the bottom side of the second panel, the pointer will indicate the appropriate termination point of the bottom side of the bust dart. In order to indicate the termination point of the upper side of the bust dart, a second flap may be provided that is co-axially pivoted with the first flap and which has a pointer indicating the termination point of the said upper side of the bust dart. A position indicating means for example in the form of markings on the second panel may then be provided to indicate the required position of the second flap in accordance with the position of the first flap.

The first panels, the second panels and the spine may also have design variation pointers by means of which design features may be provided on the pattern to cater for styling requirements. These design variation pointers may be in the form of numerals provided along peripheral portions of the first panels, the second panels and the spine.

In a preferred form of the invention, the rib may project at right angles to the spine and may be slidably displaceable with respect to the spine. Furthermore, the first and second panels may also be slidably displaceable along the rib.

According to a second aspect of the invention, there is provided a pants design aid for assisting a person in providing a pattern for a pair of pants, including a first template section;

a second template section which is secured to the first template section and is adjustably displaceable with respect thereto and which overlaps the first template section on one side of the first template; and a third template section which is also secured to the first template section and is adjustably displaceable with respect thereto and which overlaps the first template section on an opposite side to the second template section.

A crutch depth varying means may be provided for varying the depth of the crutch of the pants. A hip width varying means may also be provided for varying the hip dimension of the pants. Furthermore, the length of the crutch of the pants may be varied by means of a crutch length varying means. Thus, the design aid may include two pivotally displaceable members, in order to vary the hip dimension. A first member may be pivotally secured at one end to an upper outer corner portion of the third template section and a second member may be pivotally secured to the first member in the region of that part of the first member that corresponds with the hip, the two members being secured to the third member at their lower ends by means of a screw and nut, suitable slots being provided in the first and second members in which the screw is received. Similarly, the crutch depth varying means may comprise a third member pivotally secured at one end to the second template section at a bottom outer corner region thereof and which terminates at its other upper end in the region of the crutch portion of the second template section. As regards the crutch length varying means, this may be effected by providing a series of markings on that portion of the second template section which corresponds with the fly portion of the crutch, whereby in use the design aid may be displaced the required amount to increase the length of the crutch.

The first template section may have at its upper side, a waist dart position and shape indicating means, in the form of suitable notches and apertures, or by way of suitable markings on the first template section.

The pants design aid may also include a size indicating means, for indicating the extent and manner in which the second and third template sections should be displaced with respect to the first template section, in accordance with the desired size of pants. This size indicating means may conveniently be effected by providing reference markings on the second and third template sections and size gradation markings on the first template section.

The first, second and third template sections may also have design variation pointers by means of which various design features may be provided on the pattern to effect styling of the pants. As with the bodice design aid, these variation pointers may be in the form of numerals provided on peripheral portions of the first, second and third template sections.

The second and third template sections may conveniently be slidably displaceable with respect to the first template section.

According to a third aspect of the invention, there is provided a garment design aid for assisting a person in providing a pattern for a garment, the design aid including a hip dimension varying means for varying the hip dimension of the garment.

This hip dimension varying means may comprise a first member pivotally attached at one end to a pattern template for the garment and a second member pivotally attached at one end to the first member intermediate the first member's ends, with the free ends of the first and second members being secured to the pattern template by means of a screw and nut, the screw passing through suitable slots in the first and second members.

According to a fourth aspect of the invention, there is provided a skirt design aid for assisting a person in providing a pattern for a skirt, the design including four template sections that are interconnected and are relatively displaceable as follows:

a first substantially triangular template section, its apex being located at the waist side of the pattern;

a second substantially rectangular template section, the first template section being pivotally secured at its apex to an upper corner portion of the second template section, and with the degree of pivotal overlap of the first and second template sections being adjustable;

a third template section that is also substantially rectangular that is secured to the second template section in a linear sliding manner; and a fourth template section that is also substantially rectangular and is secured to the third template section in a linear sliding manner.

The fourth template section may be secured to the third template section so that they are both pivotally and linearly relatively displaceable.

The skirt designing aid may have a hip adjusting means similar to that of the pants designing aid, or the garment designing aid referred to above. However, with this embodiment, the first hip adjusting member may be attached to either the first or the fourth template section. Further, the first template section may be pivotally secured at its bottom end to either the first or the fourth template section, the first and the second hip adjusting members being adjustably secured at their upper ends to the first or the fourth template section.

The third template section may also have at its upper end a dart defining means. This may be effected similarly as before, by means of notches and apertures, or by other suitable markings on the third template section.

Some or all of the first, second, third and fourth template sections may have pointers by means of which design features may be incorporated in the pattern, as before these pointers being in the form of numerals provided on peripheral portions of the first, second, third or fourth template sections.

The skirt design aid may also include a size indicating means in the form of suitable markings on the template sections, for indicating the manner and extent to which the template sections must be displaced relative to one another to provide the required size and design of skirt.

The spine and rib of the bodice design aid are preferably of a suitable synthetic plastics material and are preferably moulded in a suitable mould. As regards the first and second panels of the bodice design aid, the template sections of the pants and skirt design aids, and the first and second members of the hip adjusting means, these may be of a suitable sheet material. Preferably they are of a suitable synthetic plastics material although they may also be of a cardboard or similar material.

The invention will now be described, by way of example, with reference to the accompanying drawings in which:

FIGS. 6, 7, 8 and 9 show schematically various top and bottom panels which may be used with the design aid shown in FIGS. 1 to 5;

FIG. 10 shows a further bottom panel for the bodice design aid, with which the waist dimension may be varied, a bust dart being varied accordingly;

Figure 1:
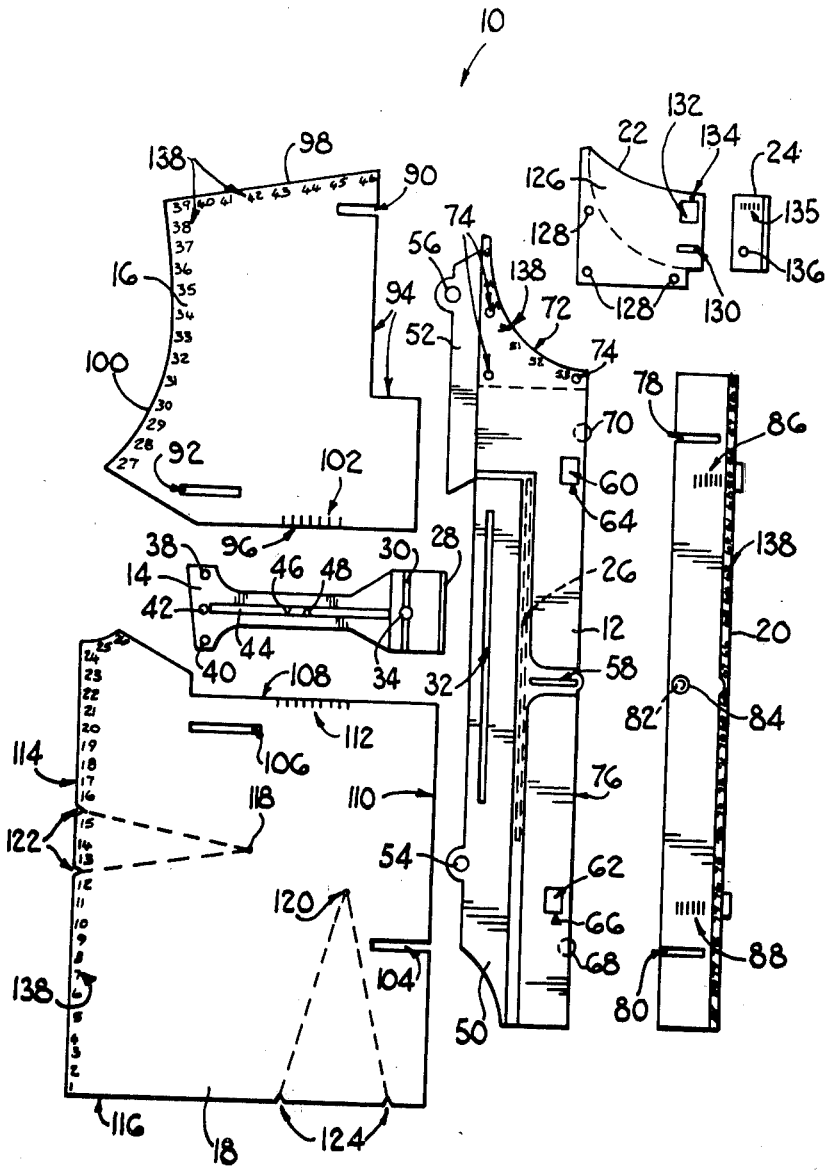
FIG. 1 shows a bodice design aid in accordance with the invention, in an exploded view.
Figure 2:
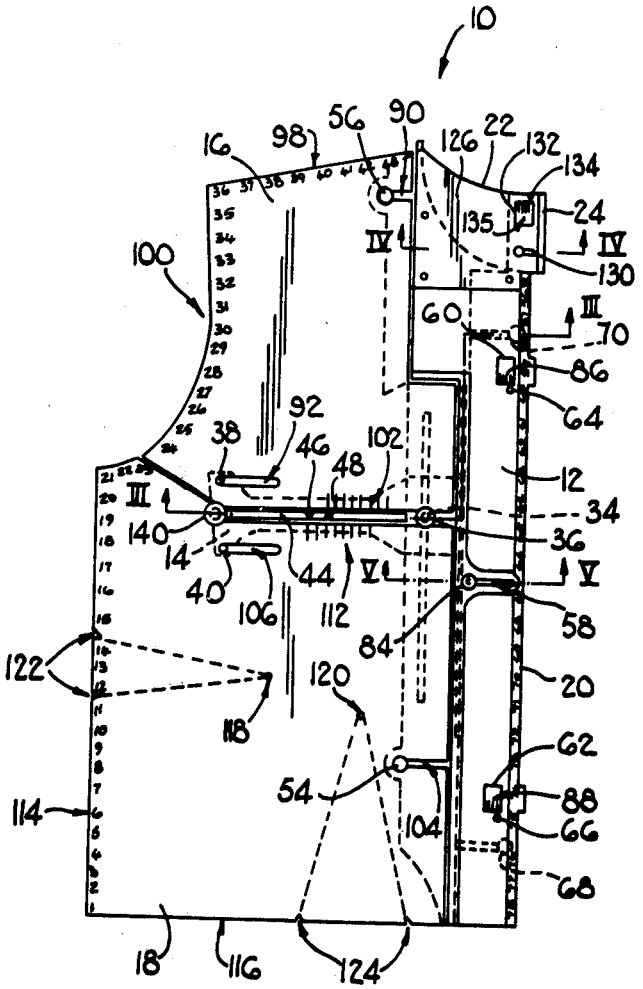
FIG. 2 shows the bodice design aid of FIG. 1 in an assembled configuration.
Figure 3:
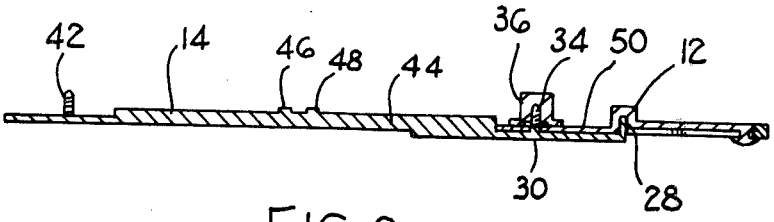
FIG. 3 shows a sectional view of the rib, spine and edge member of the bodice design aid along line III—III in FIG. 2.
Figure 4:
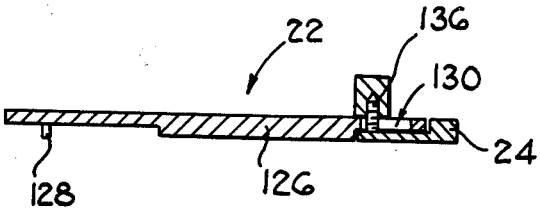
FIG. 4 shows a sectional view of the back neck opening defining member of the design aid along line IV—IV in FIG. 2.
Figure 5:
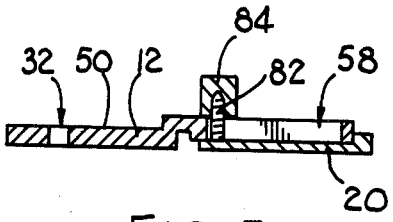
FIG. 5 shows a sectional view of the spine with its edge member along line V—V in FIG. 2.

FIGS. 1 to 5 are initially referred to. In FIGS. 1 and 2 is shown a bodice design aid 10, which is in accordance with the invention. The bodice design aid 10 comprises a rigid spine 12, a rigid rib 14, a top panel 16, a bottom panel 18, an adjustable edge member 20, and a back neck opening defining member 22 which has an adjustable edge member 24. The spine 12 and the rib 14 are of a rigid synthetic plastics material and are each moulded in suitable moulds. The rib 14 is engageable with the spine 12 to project therefrom at right angles, and is slidably longitudinally displaceable with respect to the spine 12. The spine 12 has on its underneath side a longitudinally extending channel 26 in which a lip 28 at one end of the rib 14 is engaged. The rib 14 is guided by means of a ridge 30 which is received in a slot 32 in the spine 12. Projecting from the rib 30 is a bolt 34 which together with a nut 36 is used to secure the rib 14 in a desired position on the spine 12. The rib 14 is substantially "I" shaped, the lip 28 and the ridge 30 being located at one end and with two pins 38 and 40 being provided at the other end together with a further bolt 42. Extending longitudinally along the length of the web of the "I" is a ridge 44 having two markers 46 and 48. The rib 12 further has two ledges 50 and 52, the slot 32 being provided in the ledge 50. Projecting upwardly from the ledges 50 and 52 are two headed studs 54 and 56. As is most clearly seen in FIG. 1, the ledge 52 is on the rib side of the spine 12 at the upper end thereof. Further, the ledge 50 at its lower end is recessed, the purpose of this recess being explained below. On the other side of the channel 26 to the ledge 50 the spine 12 has a transversely extending slot 58 and two windows 60 and 62. At the edge of the windows 60 and 62 there are marked pointers 64 and 66 respectively. Towards the bottom and top ends of the spine 12, close to its side that is remote from the ledges 50 and 52 are two downwardly projecting headed studs 68 and 70 respectively. The upper end 72 of the spine 12 is curved to define a front neck opening and also has three bores 74. The edge member 20 is elongate and has the same length as the outer side 76 of the spine 12. Two slots 78 and 80 are provided in the edge member 20 as well as an upwardly projecting bolt 82. The edge member 20 is slidably engaged with the spine 12, the slots 78 and 80 engaging the stud 70 and 68 respectively with the bolt 82 projecting through the slot 58. The edge member 20 is secured in any desired position by means of a nut 84 which screw-threadedly engages the bolt 82. The position of the edge member 20 is set utilising gradations 86 and 88 which are visible through the window 60 and 62 respectively and are referenced by means of the pointers 64 and 66 respectively.

If regard is now had to the upper panel 16, it will be seen that it has two slots 90 and 92 which are engaged with the stud 56 and the pin 38 respectively. It will be appreciated that the top panel 16 is supported on the ledge 52, a portion of the ledge 50, and by the rib 14 on its side regions 94 and 96. It will further be appreciated that the upper side 98 of the top panel 16 defines a shoulder seam of the bodice, and its outer curved side 100 defines a part of the arm-hole seam of the bodice. Along its lower side 96, there are gradations 102 which are referenced by the marker 48. The bottom panel 18 similarly has two slots 104 and 106 which are engaged with the stud 54 and pin 40 respectively. As with the top panel 16, the bottom panel 18 is supported on the ledge 50 and the rib 14 along its upper and inner sides 108 and 110. Further gradations 112 are marked along the upper side 108, which are referenced by means of the marker 46. Further, the outer side 114 defines the side seam of the bodice, and the lower side 116 defines the waist opening of the bodice. The position and shape of two darts is indicated by means of two apertures 118 and 120 and two sets of notches 122 and 124 in the outer side 114 and the lower side 116 respectively. It is now understood that the recess in the ledge 50 permits the provision of a dart close to the inner side of the bottom panel 18.

Referring now to the back neck opening defining member 22, it will be seen that it comprises a body member 126 which has three pins 128 which are received in the bores 74, a slot 130, a window 132 and a pointer 134. Its edge member 24 has a bolt 136 which passes through the slot 130 to be secured in position by means of a nut, and gradations 135 which are referenced by the marker 134 to indicate the position of the edge member 24.

Finally, a series of design numerals 138 is marked along the outer side 114 of the bottom panel 18, the outer and upper sides 100 and 98 of the top panel 16, along the neck defining side 72 of the spine 12, and along the outer side of the edge member 20.

As will be seen in FIGS. 6, 7, 8 and 9, various different types of top and bottom panels 16 and 18 are shown which may be used with the spine 12 and rib 14 to provide various different bodice patterns.

The bodice design aid 10 is used in the following manner. First, the top and bottom panels 16 and 18 of the required style and pattern are selected and engaged with the spine 12 and rib 14, being secured thereon by means of the nut 36 and a nut 140 which engages the bolt 42. The top and bottom panels 16 and 18 are displaced towards or away from the spine 12 in accordance with the bust size that the bodice is to have, the various bust sizes being indicated by the gradations 102 and 112. The edge member 20 is also suitably adjusted in accordance with the required bust size, utilising the gradations 86 and 88. The design aid 10 is then placed on a sheet of paper or on the fabric itself and the outline drawn on the paper by means of a pencil or the like. The back neck opening defining member 22 is removed to draw the pattern for the front panels of the bodice, and is placed in position on the spine 12 in order to obtain the pattern for the back panels. Naturally, the edge member 24 of the back neck opening defining member 22 is also set to the required size utilising the gradations 135.

Referring to FIG. 10, a bottom panel 142 is shown which has a means for varying the waist size of the pattern and for suitably positioning a bust dart in accordance with the waist size. In order to vary the waist size, a first member 144 is provided which at its upper end is pivoted to the panel 142 at its upper and outer corner by means of a pivot pin 146. The member 144 extends down to the lower side 116 of the panel 142 and at its lower end has a slot 148 in which is located a bolt fast with the panel 142 and having a nut 150. This member 144 accordingly varies the outer edge 152 of the panel 142, by pivoting of the member 144. The increase in the waist dimension is indicated by means of a marker 154 on the member 144 and gradations 156 on the panel 142.

The member 144 also has a notch 158 which together with a notch 160 in a further member 162 and an aperture 164 in the panel 142, define a bust dart having an upper edge 166 and a lower edge 168. The aperture 164 indicates the bust point. The member 162 is also pivotally attached at its upper end to the panel 142 by the pivot pin 146. On this member 162 is a pointer 172 which references a set of gradations 174 on the panel 142. When the member 144 is pivoted, it will be appreciated that the position of the notch 158 changes and accordingly the length of the line joining it to the aperture 164. In order to ensure that with the notch 158 in this new position, the length of the upper edge 166 is equal to that of the lower edge 168, the other member 162 is pivoted so that its pointer 172 references the corresponding gradation 174 to the gradation 156 referenced by the marker 154. In this position, the length of the line 166 joining the aperture 164 to the notch 160 will be the same as that of the line 168 joining the aperture 164 to the notch 158 thereby providing a suitable dart and retaining the position of the bust point 164.

If various styling changes are to be made, the reference numerals 138 are utilised together with suitable instructions, suitable lines being marked on the pattern by joining appropriate reference numerals with appropriate lines, to effect the styling changes required.

Figure 11:
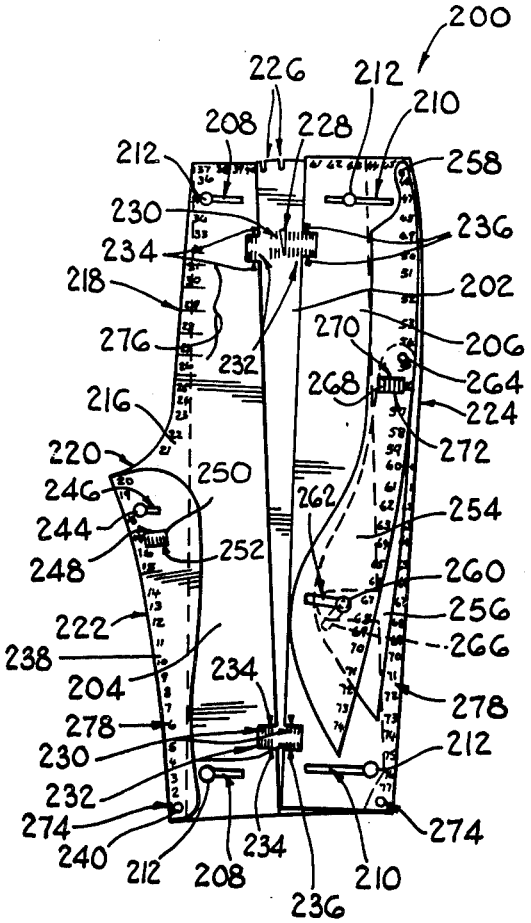
FIG. 11 shows a pants design aid in accordance with the invention.

Referring now to FIG. 11, shown therein is a pants designing aid 200. The pants designing aid 200 has a first template section 202, a second template section 204, and a third template section 206. The second template section 204 and the third template section 206 are slidably secured to the first template section 202 by means of bolts which are fast with the first template section 202 and which extend through slots 208 and 210 in the second and third template sections 204 and 206 respectively, the bolts being engaged by nuts 212. The second and third template sections 204 and 206 overlap different sides of the first template section 202. The side 214 of the second template section 204 which extends beyond the first template section 202 is shaped to define the crutch and inner leg seams of the pants. Thus, the second template section 204 has a side edge region 218 which defines the fly portion of the crutch seam, a portion 220 which defines the lower portion of the crutch seam, and a portion 222 which defines the inner leg seam. The outer edge 224 of the third template section 206 defines the outer leg seam of the pants. Further, the upper sides of the first, second and third template sections 202, 204 and 206 define the waist opening of the pants. Intermediate the sides of the first template section 202, and at its upper end, there are provided two notches 226 and a triangular aperture 228 which define a waist dart. Marked on the first template section 202 are two sets of size gradations. A first set 230 it utilised if the pants is to have a dart, and the other set 232 is utilised if the pants does not have a dart. In order to reference the gradations 230 and 232, pointers 234 are provided on the second template section 204 and pointers 236 are provided on the third template section 206.

The pants designing aid 200 further has a crutch depth varying member 238 which is pivotally secured at its lower end to the bottom outer corner of the second template section 204 by means of a pivot pin 240 and which varies the length of the edge portion 220 by pivotal displacement. The position of the member 238 may be adjusted by means of a bolt and nut 244 and a slot 246 in the member 238. The member 238 further has a window 248 by means of which size gradations 250 on the second template section 204 may be referenced by means of a pointer 252 on the member 238.

The hip dimension of the pants may be varied by means of two members 254 and 256. The member 254 is pivotally secured at its upper end to the upper corner of the third template section 206 by means of a pivot pin 258, the member 254 being secured in the desired pivotal position by means of a nut and bolt arrangement 260 which engages a slot 262 in the member 254. The other member 256 is pivotally secured at its upper end to the member 254, intermediate its ends, by means of a pivot pin 264. The pivot pin 264 is positioned to correspond with the hip region of the pants. The member 256 is also engaged with the nut and bolt 260 by means of a slot 266. It will be appreciated that by pivoting the member 254, the member 256 is also displaced, thereby altering the profile of the edge 224 to enlarge the hip dimension. The amount of displacement required is indicated by means of gradations 268 on the member 256 which are visible through a window 270 in the member 254 and which are referenced by means of a pointer 272.

At their lower outer corners, the second and third template sections 204 and 206 have apertures 274 by means of which a further design aid (not shown) for designing the lower leg portions of the pants, may be attached to the pants design aid 200 shown in FIG. 11.

To use the design aid 200 the second and third template sections 204 and 206 are adjusted in accordance with the required size, utilising the gradations 230 or 232 and the pointers 234 and 236. The members 238, and 254 and 256 are then adjusted if required, to provide the required crutch depth and hip size. The design aid 200 is then placed on a sheet of paper, and the outline of the upper portion of the design aid 200 drawn thereon, to provide the upper portion of the pattern. A number of gradations 276 are provided on the second template section 204 along the edge portion 218, by means of which the length of the fly portion of the crutch is varied. Thus, once the outline of the upper portion of the design aid 200 has been traced, the design aid 200 is shifted down the required amount as indicated by the gradations 276 and the rest of the outline traced to provide a pattern for the pants. If any styling variations are required, a set of numerals 278 is provided along the outer and upper sides of the second and third template sections 204 and 206. In order to make styling variations, these numerals 278 are utilised in accordance with a set of instructions, to draw various patterning lines on the pattern.

Figure 12:
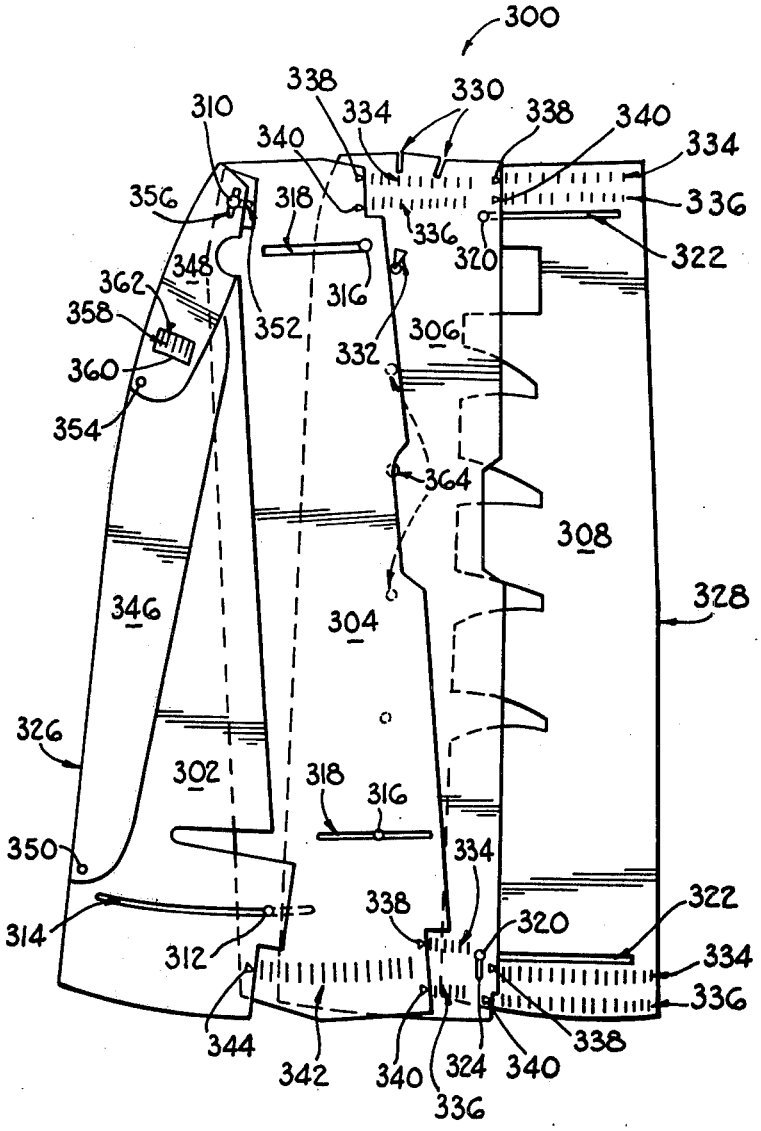
FIG. 12 shows a skirt design aid in accordance with the invention.

A skirt design aid is now described with reference to FIG. 12, the design aid being indicated by reference numeral 300. The skirt design aid 300 comprises four template sections, a first template section 302 a second template section 304, a third template section 306 and a fourth template section 308. The first template section 302 is substantially triangular in shape, and the other three template sections 304, 306 and 308 are substantially rectangular. The first template section 302 is pivotally attached at its upper apex end to the top left-hand corner of the second template section 304 by means of a pivot pin 310. The pivot pin 310 is in the form of a nut and bolt arrangement, the purpose of which will be explained below. The position of the first template section 302 relative to the second template section 304 may be varied by means of a further nut and bolt arrangement 312, the bolt being fast with the second template section 304 and being slidable in a slot 314 in the first template section 302. The third template section 306 is slidably attached to the second template section 304 in an adjustable manner, by means of nut and bolt arrangements 316 and slots 318 provided in the second template section 304. Similarly, the fourth template section 308 is slidably secured to the third template section 306 to be both linearly and pivotally displaceable, by means of nut and bolt arrangements 320 suitable slots 322 being provided in the fourth template section 308 and a slot 324 being provided in the third template section 306. The outer edges 326 and 328 of the first and fourth template sections 302 and 308 respectively define the sides of skirt panels which are utilised to form the skirt. The upper ends of the template sections define the top edge of the panels, and the bottom ends of the template sections define the bottom edge of the skirt panels. At its upper end, the third template section 306 has two notches 330 and a triangular aperture 332 which define a waist dart. On the third template section 306 and on the fourth template section 308, are provided two sets of gradations, 334 and 336, both at the top and at the bottom of the template sections. Appropriate pointers 338 and 340 are provided on the second and third template sections 304 and 306 to reference the gradations 334 and 336. A further set of gradations 342 is marked on the bottom portion of the second template section 304, these gradations being referenced by a pointer 344 provided on the first template section 302.

The skirt design aid also has a hip adjusting means, in the form of two members 346 and 348. The member 346 is pivotally attached at its bottom end to the first template section 302 towards its bottom end by a pivot pin 350. At its upper end, the member 346 has a slot 352 which is engaged by the nut and bolt arrangement 310. The member 348 is pivotally attached at its bottom end to the member 346 in the hip region of the skirt, by a pivot pin 354. This member 348 also has a slot 356 which is engaged by the nut and bolt arrangement 310. It will be appreciated that by pivoting the member 346, the member 348 is also displaced, thereby altering the outline of the outer edge 326 and thereby increasing the hip size of the pattern. The extent to which the hip size is increased is indicated by a set of gradations 358 marked on the member 346 which is visible through a window 360 in the member 348 and which are referenced by means of a pointer 362. The nut and bolt arrangement 310 is utilised to release the members 346 and 348 so that they may be adjusted and then secured in the required configuration. A number of apertures 364 is provided in the third template section 306 by means of which styling changes may be effected.

In use, the relative positions of the second and fourth template sections 304 and 308 with respect to the third template section 306 are varied in accordance with the size required, the required size being indicated by the gradations 334 and 336. The gradations 334 are the appropriate gradations if the pattern is to have a dart (utilising the notches 330 and the aperture 332), and the gradations 336 are utilised if the pattern does not have a dart. If the skirt is to be flared, the first template section 302 is pivoted with respect to the second template section 304, the required amount. If a large amount of flaring is required, the fourth template section 308 is also pivoted, the nut and bolt arrangement 320 then sliding in the slot 324. Further, if the skirt is to have pleats, whether of the knife or box type, the fourth template section 308 is accordingly extended.

In use, the skirt design aid 300 is extended as required, in accordance with the size and type of skirt desired, then placed on a sheet of paper and its outline drawn on the paper.

I claim:

1. A bodice design aid for assisting a person in providing patterns for a bodice of different designs, of various sizes, the design aid including:

a rigid spine having an upper end shaped to provide a neck opening;

a rigid rib projecting outwardly at right angles from the spine to define an upper quadrant on one side of the rib and a lower quadrant on the other side of the rib and adjustably displaceable longitudinally along the spine;

a plurality of first panels of different designs, one of which is selected and detachably secured to the rib and to the spine to fill the first quadrant;

a plurality of second panels of different designs, one of which is selected and detachably secured to the rib and to the spine to fill the second quadrant; said first and second panels being adjustably displaceable laterally with respect to the spine and the rib; and securing means for detachably securing the said first panel and a second panel to the rib and the spine.

2. A bodice design aid as claimed in claim 1, in which the spine has an adjustable edge member on its side opposed to the rib that is adjustably displaceable towards and away from the spine.

3. A bodice design aid as claimed in claim 1, in which one of the second panels has a length varying means for adjusting the length of its lower side and the said second panel also has a bust dart indicating means, and a dart varying means to vary the shape and position of the bust dart in accordance with the length of the second panel's lower side.

4. A bodice design aid as claimed in claim 3, in which the dart varying means are adapted to maintain the lengths of the sides of the bust dart equal with respect to a predetermined bust point as the length of the second panel's lower side is varied and the length varying means comprise a first flap that is pivotally secured at one end to an upper and outer corner portion of of the second panel and which has a pointer indicating the termination point of the bottom side of the bust dart, and the bust dart indicating means comprise a second flap that is co-axially pivoted with the first flap and has a pointer indicating the termination point of the upper side of the bust dart; a position indicating means being provided to indicate the required position of the second flap in accordance with the position of the first flap.

5. A bodice design aid as claimed in claim 1, in which the upper end of the spine is shaped to provide a front neck opening and includes a back neck opening defining member which is removable securable to the upper end of the spine.

6. A bodice design aid as claimed in claim 1, in which the first panels, the second panels and the spine have design variation pointers by means of which design features may be provided on the pattern.

7. A bodice design aid as claimed in claim 1, in which the upper sides of the first panels define a shoulder seam, and their outer sides define all or part of an armhole seam of the bodice.

8. A bodice design aid as claimed in claim 1, in which at least a part of the outer sides of the second panels define a side seam of the bodice.

* * * * *